US007928335B2

(12) United States Patent
Fujiwara

(10) Patent No.: US 7,928,335 B2
(45) Date of Patent: Apr. 19, 2011

(54) OPERATING KEY PART

(75) Inventor: Yasuhito Fujiwara, Nara (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 294 days.

(21) Appl. No.: 12/301,756

(22) PCT Filed: Apr. 27, 2007

(86) PCT No.: PCT/JP2007/059198

§ 371 (c)(1),
(2), (4) Date: Nov. 20, 2008

(87) PCT Pub. No.: WO2007/135842

PCT Pub. Date: Nov. 29, 2007

(65) Prior Publication Data

US 2009/0152088 A1 Jun. 18, 2009

(30) Foreign Application Priority Data

May 22, 2006 (JP) ..... 2006-141784

(51) Int. Cl.
*H01H 13/88* (2006.01)

(52) U.S. Cl. ..... 200/341; 200/343

(58) Field of Classification Search ..... 29/622; 200/5 A, 296, 341–345

See application file for complete search history.

(56) References Cited

U.S. PATENT DOCUMENTS

| | | | | | |
|---|---|---|---|---|---|
| 4,315,114 | A * | 2/1982 | Monti, Jr. | ..... | 200/5 A |
| 4,582,967 | A * | 4/1986 | Brumit et al. | ..... | 200/5 A |
| 4,771,143 | A * | 9/1988 | Hoffmann | ..... | 200/512 |
| 4,892,981 | A * | 1/1990 | Soloway et al. | ..... | 200/5 A |
| 4,977,298 | A * | 12/1990 | Fujiyama | ..... | 200/5 A |
| 5,788,060 | A * | 8/1998 | Kuroda | ..... | 200/343 |
| 6,160,232 | A * | 12/2000 | Lin | ..... | 200/341 |
| 6,169,256 | B1 * | 1/2001 | Hanahara et al. | ..... | 200/5 A |
| 6,384,355 | B1 * | 5/2002 | Murphy et al. | ..... | 200/344 |
| 7,071,434 | B1 * | 7/2006 | McConnell et al. | ..... | 200/310 |
| 7,186,938 | B2 * | 3/2007 | Ito | ..... | 200/512 |
| 7,564,002 | B2 * | 7/2009 | Watanabe | ..... | 200/344 |

FOREIGN PATENT DOCUMENTS

| | | | |
|---|---|---|---|
| JP | 2-141936 | U | 11/1990 |
| JP | 5-6602 | U | 1/1993 |
| JP | 6-15227 | U | 2/1994 |
| JP | 9-66561 | A | 3/1997 |
| JP | 11-126539 | A | 5/1999 |
| JP | 2000-311544 | A | 11/2000 |

* cited by examiner

*Primary Examiner* — Michael A Friedhofer

(74) *Attorney, Agent, or Firm* — Birch, Stewart, Kolasch & Birch, LLP

(57) ABSTRACT

An operating key part (60) includes hinge keys (11), protrusions (12), stoppers (13), a frame (20), and hinges (21), which are molded integrally out of thermoplastic resin. The frame (20) takes the form of a grid or lattice. Each of the hinge keys (11) is positioned in one box of the frame (20) and supported as floating through hinges (21) by the frame (20). The frame (20) has four protrusions (22) protruding from the corners of its front side. When the operating key part (60) is fitted to a main apparatus, the front ends of the frame protrusions (22) are positioned at a predetermined distance in a direction Y2 from the position to which the front sides of the hinge keys (11) have moved farthest in this direction.

5 Claims, 6 Drawing Sheets

OPERATING KEY PART

BACKGROUND OF THE INVENTION

1. Field of the Invention

The present invention relates to a part of an operating key device such as the ten-key pad fitted to a telephone, a fax machine, or the like.

2. Description of the Related Art

A main apparatus such as a telephone or a fax machine is fitted with an operating key device such as a ten-key pad, which can be operated to enter a receiver's number or start a function. The operating key device may have a push button structure as shown in FIG. 5 (for example, refer to Patent Document 1).

FIG. 5 is an explanatory drawing for explaining the structure of a single operating key device. The operating key device 100 includes a key 110, hinges 120, a frame 130, and a tact switch 140. The key 110 includes a key top 110A and a flanged part 110B.

The outer wall 200 of a main apparatus has a hole 210 formed through it. The key top 110A protrudes through the hole 210 from the inside of the outer wall 200 to the outside of the wall. The flanged part 110B restricts the protrusion of the key top 110A from the hole 210. The flanged part 110B supports a protrusion 110C on its back side. The protrusion 110C protrudes from the backside of the flanged part 110B toward the tact switch 140. The protrusion 110C pushes the tact switch 140 by moving in the direction Y1 in which the key top 110A can be pushed.

The frame 130 supports the key 110 as floating by means of the hinges 120 and is fixed to the outer wall 200. The tact switch 140 is connected to a circuit board, through which it outputs to the controller of the main apparatus a signal indicating whether an entry operation has been performed. The key 110, hinges 120, and frame 130 are molded integrally out of thermoplastic resin.

FIG. 6 shows an operating key device of last years. In order for this device to be improved in design, its key includes a key top 310A and a hinge key 310B which are separate from each other, and the key top 310A is formed of transparent resin. The key top 310A and hinge key 310B are separate from each other because, if the whole key were formed of transparent resin, the inside of the operating key device would be visible, so that the device would not be desirable in design, and because transparent resin has a property not suitable for the formation of a thick member.

The front side of the hinge key 310B comes into contact with the key top 310A in the direction opposite to a direction Y1 so as to hold the key top 310A between it and an outer wall 200. The hinge key 310B has a protrusion 310C formed on its back side, which pushes a tact switch (not shown). The hinge key 310B is supported as floating through hinges 320 by a frame 330. The front side of the key top 310A is coated in color and shows a number or the function of the operating key. The contact surfaces of the key top 310A and hinge key 310B are flat to have a good appearance to the user.

In FIG. 6, which shows the operating key device 310 as fitted to a main apparatus, the front sides of the frame 330 and hinge key 310B are not flush with each other. However, the front sides of the frame 330 and hinge key 310B have conventionally been designed to be flush with each other so that the key top 310A can be mounted easily on the front side of the hinge key 310B.

An operating key part consists of the hinge key 310B, hinges 320, and frame 330 and is molded integrally out of thermoplastic resin. The operating key part is kept with its front side up on a keeping tray or the like after it is molded integrally and until it is fitted to the main apparatus.

Patent Document 1: JP 2000-311544 A

SUMMARY OF THE INVENTION

Problems to be Solved by the Invention

However, the operating key part of an operating key device including a key top and a hinge key which are separate from each other is put with its front side up immediately after it is integrally molded and before its resin hardens completely. As a result, the resin hardens with the hinge key supported in a position lowered by its weight below the position where it should be supported.

The hinge key supported in the low position comes into contact with the key top in a low position when the operating key device is fitted to a main apparatus. The key top and the hinge key are not bonded to each other, so that the key top is vertically loose. If the key top and the hinge key were bonded to each other, the key top would protrude less from the outer wall, so that the appearance of the main apparatus would be ruined in design. For an operating key device including a key top and a hinge key which are molded integrally, the molded parts are kept likewise, so that likewise the key top protrudes less.

In order to prevent the supporting position from lowering, the operating key part might be put with its front side down on a keeping tray or the like immediately after the part is molded integrally and before its resin hardens completely. In this case, the front side of the hinge key would come into contact with the supporting surface of the keeping tray. As a result, if there is a foreign body on the supporting surface, or if the surface is not perfectly flat, the supporting position would lower, or the shape, plane direction or the like of the front side of the hinge key would change. This might make it impossible for the hinge key to properly support the key top. For an operating key device including a key top and a hinge key which are molded integrally, the key top protrudes from the front side of the frame, so that the key device cannot be put with the key top down on a keeping tray or the like.

The object of the present invention is to provide an operating key part which can restrain the decrease in the protrusion of its key top from the outer wall of a main apparatus and the looseness of the top with a simple structure, and maintain the design of the appearance of the apparatus.

Means for Solving Problem

An operating key part according to the present invention comprises a key, a hinge, and a single frame, which are molded integrally out of thermoplastic resin. The key comes into contact with a switch fitted to a main apparatus by moving in a pushing direction from its front side to its back side. The frame is positioned near a side of the key and supports the key as floating by means of the hinge. The frame has at least three protrusions positioned on its front side around its center of gravity. The front ends of the frame protrusions are positioned at a predetermined distance in the direction opposite to the pushing direction from the position to which the front side of the key has moved farthest in the direction opposite to the pushing direction when the front side of the key is fitted to the main apparatus. The frame protrusions are fitted to the main apparatus after they are cut at points which do not protrude from at least the outer wall of the apparatus when the protrusions are fitted to the apparatus.

When the operating key part is put on a supporting surface, with the front side of the frame down, the whole of the key part is supported by the frame protrusions, with the key supported as floating out of contact with the supporting surface.

If the operating key part is kept on the supporting surface, with the front side of the frame down, immediately after the key part is molded integrally and until it is fitted to the main apparatus, the weight of the key deforms the hinge, so that the key part hardens with the front side of the key displaced toward the supporting surface. The displacement of the front side of the key is limited to the length of the frame protrusions. Whenever no pushing force acts on the front side of the key, with the operating key part fitted to the main apparatus, this side stops in the position to which it has moved farthest in the direction opposite to the pushing direction.

Because the frame protrusions are fitted to the main apparatus after they are cut at points which do not protrude from at least the outer wall of the apparatus, the apparatus does not worsen in design.

The key may consist of a hinge key and a key top. The back side of the key top comes into contact with the front side of the hinge key. The outer wall of the main apparatus has at least one hole formed through it. The key top has a protrusion extending through the hole from the inside of the outer wall to the outside of the wall. When the key top is pushed, the hinge key moves in the pushing direction from its front side to its back side into contact with the switch, which is fitted to the main apparatus. Because the hinge key and the key top are separate parts, the part for exposure from the main apparatus and the other part can be formed of different materials.

The key top may be formed of transparent material so as to be improved in design.

The frame protrusions may be adapted to engage with positioning holes formed on the inside of the outer wall of the main apparatus. When the operating key part is fitted to the main apparatus, the frame protrusions engage with the positioning holes. The frame protrusions can be used to position the operating key part, so that there is no need to provide a new positioning structure.

Effects of the Invention

An operating key part according to the present invention may be kept as supported by protrusions on a supporting surface after it is molded integrally and until it is fitted to a main apparatus. This makes it possible to support at least one key as floating in the position to which it has moved farthest in the direction opposite a pushing direction when the operating key part is fitted to the main apparatus. It is possible to restrain the decrease in the protrusion of the key from the main apparatus and the looseness of the key with a simple structure, and to improve the appearance of the apparatus in design.

EXPLANATION OF REFERENCE NUMBERS

Figure 1:
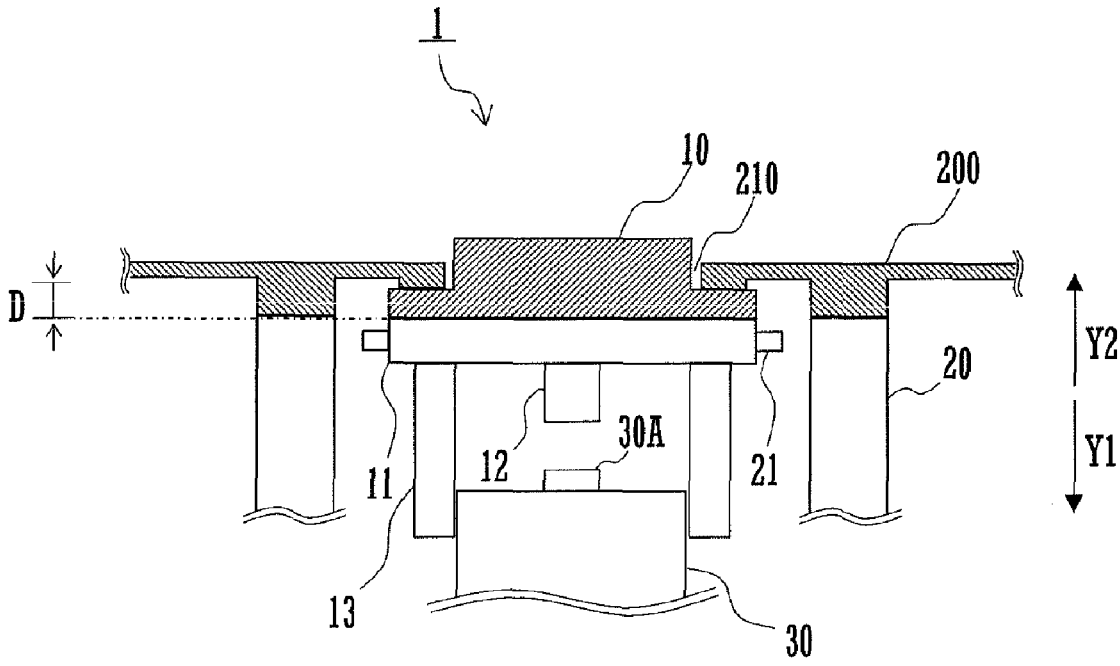
FIG. 1 is a sectional view of an operating key device including an operating key part according to a first embodiment of the present invention.

1: operating key device
10: key top
11: hinge key
12: protrusion
20: frame
21: hinge
22: protrusion
30: switch
60: operating key part
70: key

DETAILED DESCRIPTION OF THE INVENTION

Operating key devices including operating key assemblies according to the embodiments of the present invention will be described below in detail with reference to the drawings.

Figure 2A:
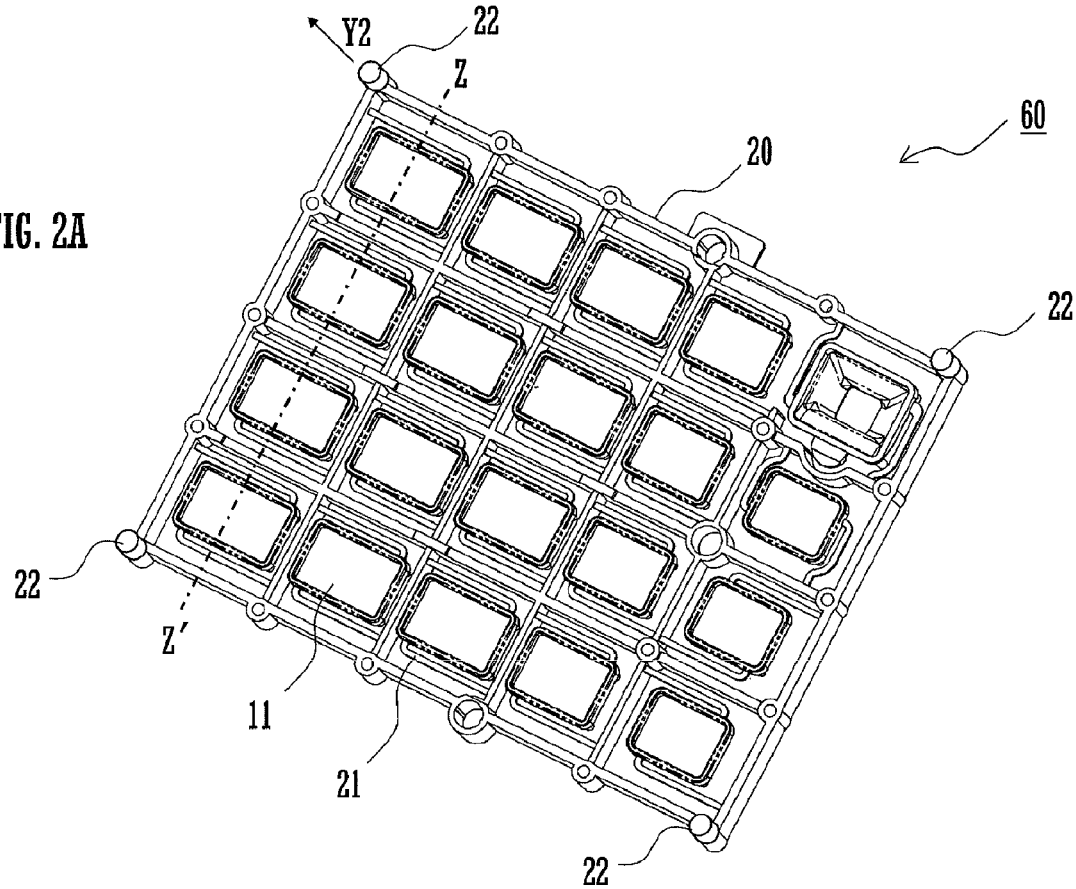
FIGS. 2A and 2B are outline drawings of the operating key part.
Figure 2B:
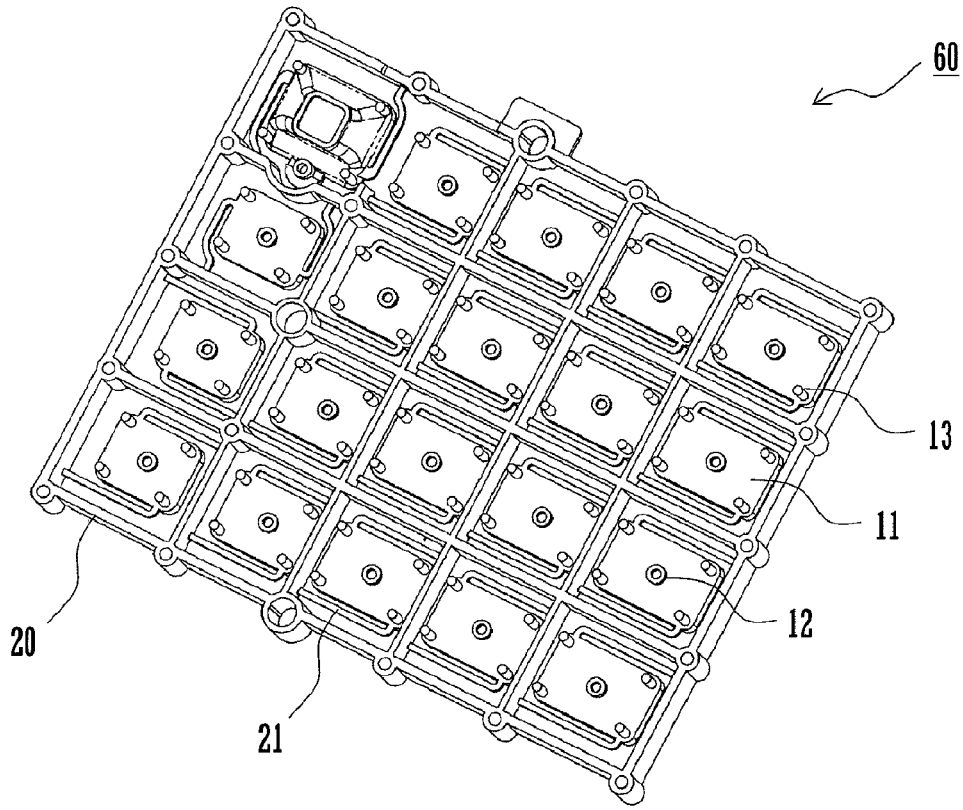

FIG. 1 is a sectional view of an operating key device including an operating key part according to a first embodiment of the present invention. FIG. 2A is a front view of the operating key part. FIG. 2B is a back view of the operating key part. Operating key devices 1 are fitted to a main apparatus such as a telephone or a fax machine and can be operated to enter a receiver's number or start a function. The operating key devices 1 include key tops 10, hinge keys 11, a frame 20, and switches 30. FIG. 1 shows the structure of one of the operating key devices 1, which are similar in structure.

The key tops 10 are supported reciprocatably in opposite directions Y1 and Y2. The direction Y1 is the pushing direction in which the key tops 10 move by being pushed by the user. Each key top 10 includes a protrusion protruding in the direction Y2 from a hole 210 formed through the outer wall 200 of the main apparatus.

The front side of each hinge key 11 comes into contact with the back side of the key top 10 in the direction Y2 so as to hold the key top 10 between the hinge key 11 and outer wall 200. The hinge key 11 supports a protrusion 12 and stoppers 13 on its back side. As shown in FIGS. 2A and 2B, the frame 20 supports the hinge keys 11 as floating by means of hinges 21.

In order for the operating key device 1 to be improved invisibility and design, the key tops 10 are formed of transparent material, and the hinge keys 11 are formed of opaque material. The front side of each hinge key 11 and the back side of each key top 10 are flat so as to be in better contact with each other, and not to impress the user complicated when he or she sees the front and back sides through the key top 10. The front side of the key top 10 shows a number or the function of the operating key with color coating. The key top 10 might not be made of transparent material, and the hinge key 11 might not be made of opaque material.

The protrusion 12 protrudes in the direction Y1 from the back side of the hinge key 11 and pushes the switch part 30A of the switch 30 when the hinge key 11 moves in the direction Y1. As shown in FIG. 2B, four stoppers 13 are positioned on the back side of the hinge key 11. The stoppers 13 restrict the movement of the key top 10 and hinge key 11 in the direction Y1 so as to prevent the user from pushing the key top 10 beyond the operable range of the switch part 30A in the direction Y1. If the key top 10 were pushed beyond the operable range of the switch part 30A in the direction Y1, the switch 30 may break.

The frame 20 takes the form of a grid or lattice. Each hinge key 11 is positioned in one box of the frame 20 and supported as floating through hinges 21 by the frame 20. The switch 30 may be a tact switch and is connected to a circuit board (not shown). When the protrusion 12 pushes the switch 30, the switch 30 outputs through the circuit board to the controller (not shown) of the main apparatus a signal indicating whether an entry has been made.

The frame 20 has four protrusions 22 protruding in the direction Y2 from the corners of its front side. When the operating key devices 1 are fitted to the main apparatus, the frame protrusions 22 engage with the positioning holes (not shown) formed in the outer wall 200. This obviates the need for the provision of new positioning members, thus restraining the cost from rising.

Hinge keys 11, protrusions 12, stoppers 13, frame 20 (including frame protrusions 22), and hinges 21 are molded integrally as an operating key part 60 of thermoplastic resin, as shown in FIGS. 2A and 2B.

Figure 3:
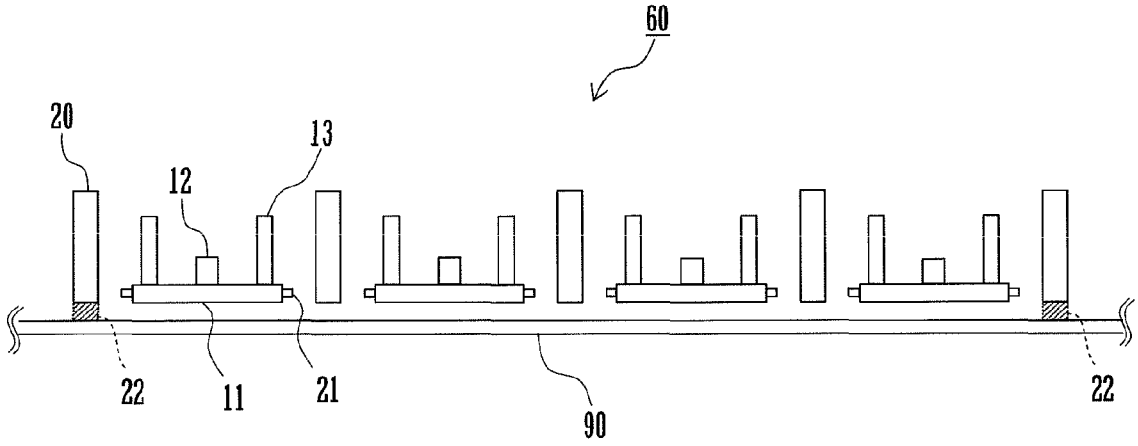
FIG. 3 is a sectional view along Z-Z' in FIG. 2A.

FIG. 3 is a sectional view along Z-Z' in FIG. 2A. The operating key part 60 is kept on a keeping tray 90 or the like after the part is molded integrally and until it is fitted as operating key devices 1 to the main apparatus. As shown in FIG. 3, the operating key part 60 is kept on the keeping tray 90 or the like, with the front side of the frame 20 down, and with the frame protrusions 22 supporting the whole of the operating key part 60. Although the frame protrusions 22 are not positioned on the cross section along Z-Z' in FIG. 2A, they are shown for explanation.

The frame protrusions 22 protrude in the direction Y2 by a distance D (FIG. 1) from the position to which the front sides of the hinge keys 11 have moved farthest in this direction, with the key tops 10 interposed, when the operating key devices 1 are fitted to the main apparatus. In other words, the frame protrusions 22 protrude by the distance D from the front sides of the hinge keys 11 positioned for their best appearance.

When the operating key part 60 is put on a plane, with the front side of the frame 20 down, the frame protrusions 22 support the whole of the part 60, with the hinge keys 11 supported as floating out of contact with the supporting surface of the keeping tray 90.

Accordingly, if the operating key part 60 is kept on a plane, with the front side of the frame 20 down, immediately after the part 60 is molded integrally and until it is fitted to the main apparatus, the weight of the hinge keys 11 deforms the hinges 21, so that the part 60 hardens with the front sides of the keys 11 displaced toward the supporting surface. The displacement of the front sides of the hinge keys 11 is limited to the length of the frame protrusions 22. Whenever no pushing force acts on the front side of each hinge key 11, with the operating key part 60 fitted to the main apparatus, this side stops in the position to which it has moved farthest in the direction opposite to the pushing direction.

Accordingly, regardless of the deformation of the operating key part 60, when the operating key part 60 is fitted to the main apparatus, the front side of at least one of the keys can be kept in the position to which it has moved farthest in the direction Y2. This keeps the front side of the key top 10 in the position to which it has moved farthest in the direction Y2.

This makes it possible to form the hinge keys 11 and key tops 10 of different materials etc., restrain the decrease in the protrusion of the tops 10 from the main apparatus and the looseness of the tops with a simple structure, and maintain the design of the appearance of the apparatus.

It is preferable that the distance D be such that, when the operating key part 60 is kept on the keeping tray 90, the front sides of the hinge keys 11 are out of contact with the supporting surface of the tray 90. The key tops 10 and operating key part 60 correspond to the operating key part of the present invention.

In this embodiment, the hinge keys 11, protrusions 12, stoppers 13, frame 20, and hinges 21 are molded integrally. It is essential that the hinge keys 11, frame 20, and hinges 21 be molded integrally.

In this embodiment, the four frame protrusions 22 are positioned at the corners of the front side of the frame 20. The present invention is not limited in particular to this, but it is essential that at least three protrusions be positioned around the center of gravity of the operating key part 60.

In this embodiment, a plurality of operating key devices 1 are provided. The present invention can also be applied to a single operating key device.

Second Embodiment

An operating key part according to this embodiment includes keys 70, each of which consists of a key top 71 and a flanged part 72. The key top 71 and flanged part 72 are integral with each other in place of a key top and a hinge key which are separate from each other. Otherwise, this embodiment is similar in structure to the first embodiment.

Figure 4:
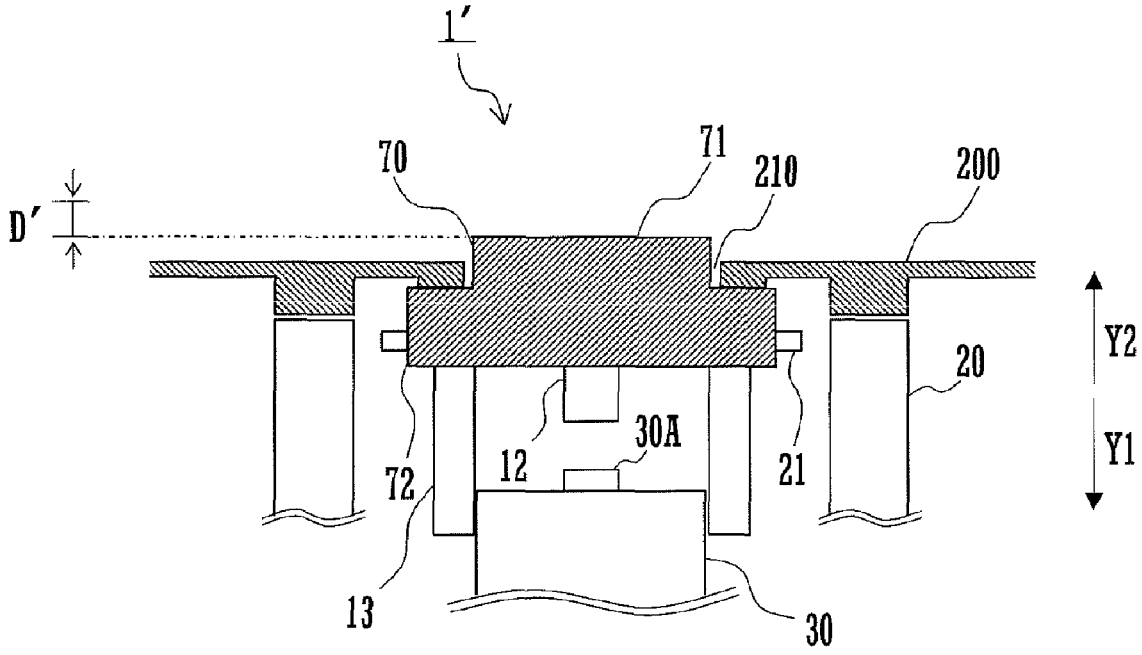
FIG. 4 is a sectional view of an operating key device including an operating key part according to a second embodiment of the present invention.
Figure 5:
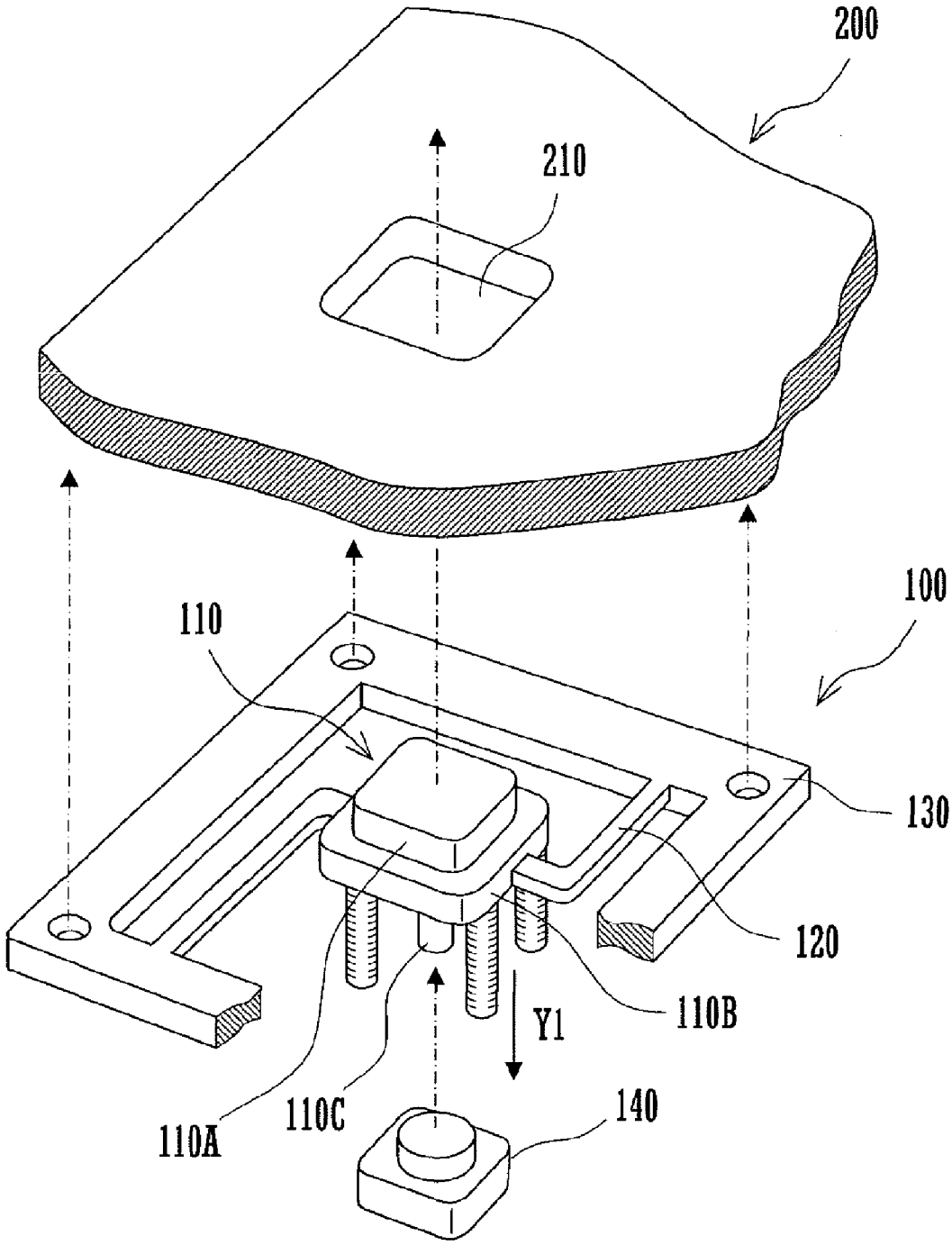
FIG. 5 is a drawing for explaining the structure of a conventional single operating key device.
Figure 6:
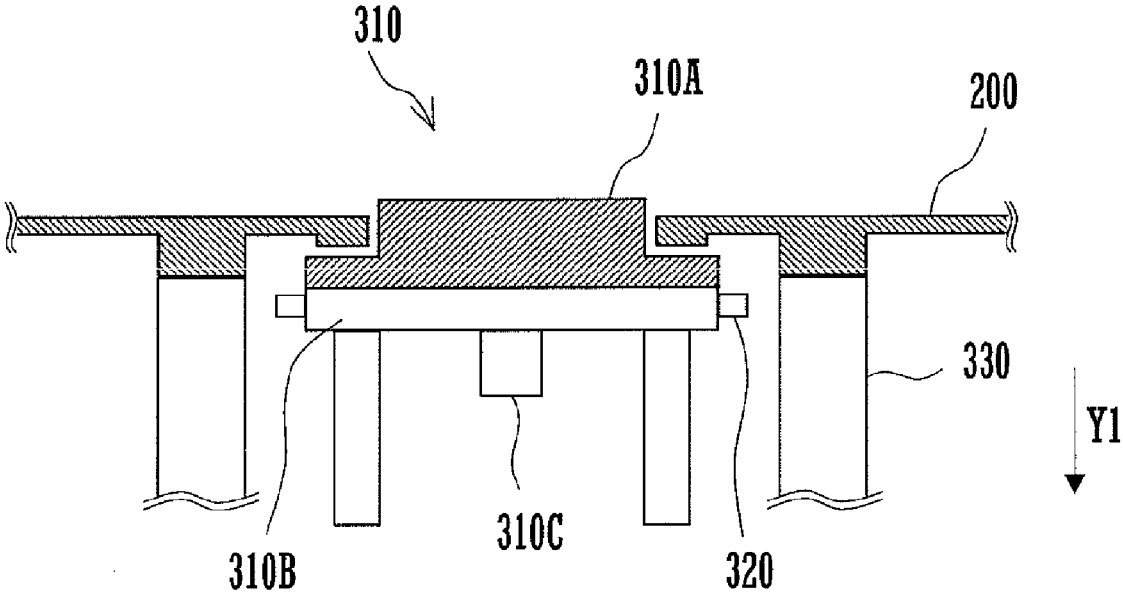
FIG. 6 is a sectional view of a conventional operating key device.

FIG. 4 is a sectional view of an operating key device including an operating key part according to a second embodiment of the present invention. In an operating key device 1', the key 70 includes a key top 71 and a flanged part 72. The key top 71 is a protrusion protruding in the direction Y2 from a hole 210 formed through the outer wall 200 of a main apparatus. The flanged part 72 restricts the protrusion of the key top 71 from the hole 210. The key 70 is supported as floating through hinges 21 by a frame 20 and supports a protrusion 12 and stoppers 13 on its back side.

In the operating key devices 1', as is the case with the operating key devices 1, the keys 70, protrusions 12, stoppers 13, frame 20, hinges 21, and frame protrusions 22 are molded integrally as an operating key part of thermoplastic resin.

As is the case with the operating key devices 1, the frame protrusions 22 protrude in the direction Y2 by a distance D' (FIG. 4) from the position to which the front sides of the keys 70 have moved farthest in this direction when the operating key devices 1' are fitted to the main apparatus.

Accordingly, when the operating key part 1' is put on a plane, with the front side of the frame 20 down, the frame protrusions 22 support the whole of the part 1', with the keys 70 supported as floating out of contact with the supporting surface of a keeping tray.

Consequently, as is the case with the operating key devices 1, the keys 70 can be supported as floating with their front sides having moved farthest in the direction Y2. This makes it possible to restrain the decrease in the protrusion of the front sides of the keys 70 from the main apparatus and the looseness of the keys with a simple structure, and to maintain the design of the appearance of the apparatus. It is preferable that the distance D' be such that, when the operating key part is kept on the keeping tray 90, the front sides of the keys 70 are out of contact with the supporting surface of the tray 90.

Before the operating key part is fitted to the main apparatus, the frame protrusions 22 are cut by a predetermined length. This length is long enough to keep the frame protrusions 22 from protruding from at least the outer wall of the main apparatus when the operating key part is fitted to the apparatus. This length may not be the whole length of the frame protrusions 22. This makes it possible to maintain the design of the appearance of the main apparatus by preventing the frame protrusions 22 from protruding from the apparatus through the outer wall 200 when the operating key part is fitted to the apparatus.

If the frame protrusions 22 are not cut, they can be used as positioning members, as stated for the first embodiment. Even if at least two of the frame protrusions 22 are cut by the predetermined length, and even if the other frame protrusions 22 are cut by their whole length, they can be used as positioning members.

The invention claimed is:

1. An operating key part, comprising:

at least one key for coming into contact with a switch fitted to a main apparatus by moving in a pushing direction from the front side thereof to the back side thereof; and a single frame positioned near a side of the key and supporting the key as floating through a hinge;

the key, the frame, and the hinge being molded integrally out of thermoplastic resin;

the frame having at least three frame protrusions positioned on the front side thereof around the center of gravity thereof;

wherein the front ends of the frame protrusions extend beyond the front side of the key by a predetermined distance in the direction opposite to the pushing direction from the position to which the front side of the key has moved farthest in the opposite direction when the front side of the key is fitted to the main apparatus; and wherein the frame protrusions are fitted to the main apparatus after the protrusions are cut at points which do not protrude from at least an outer wall of the apparatus when the protrusions are fitted to the apparatus.

2. An operating key part as claimed in claim 1, wherein the frame protrusions engage with positioning holes formed on the inside of the outer wall of the main apparatus.

3. An operating key part, comprising:

at least one key top having a protrusion and extending through at least one hole formed through the outer wall of a main apparatus from an inside of the outer wall to an outside of the outer wall;

at least one hinge key for coming into contact with a switch fitted to the main apparatus by moving in a pushing direction from a front side thereof to a back side thereof, the front side being adapted to come into contact with the back side of the key top in the direction opposite to the pushing direction; and a single frame positioned near a side of the hinge key and supporting the key as floating through a hinge;

the key top, the hinge key, the frame, and the hinge being molded integrally out of thermoplastic resin;

the frame having at least three frame protrusions positioned on the front side thereof around the center of gravity thereof;

wherein the front ends of the frame protrusions extend beyond the front side of the key top by a predetermined distance in the direction opposite to the pushing direction from the position to which the front side of the hinge key has moved farthest in the opposite direction when the front side of the hinge key is fitted to the main apparatus.

4. An operating key part as claimed in claim 3, wherein the frame protrusions engage with positioning holes formed on the inside of the outer wall of the main apparatus.

5. An operating key part as claimed in claim 3, wherein the key top is formed of transparent material.

* * * * *